US005687501A

United States Patent [19]

Stace et al.

[11] Patent Number: 5,687,501

[45] Date of Patent: Nov. 18, 1997

[54] SEALING APPARATUS FOR EXCLUSION OF WATER FROM UNDERWATER GUN BARRELS

[75] Inventors: Joseph J. Stace, Narragansett; Laurence M. Dean, Newport; Ivan N. Kirschner, Portsmouth, all of R.I.

[73] Assignee: The United States of America as represented by the Secretary of the Navy, Washington, D.C.

[21] Appl. No.: 613,814

[22] Filed: Mar. 6, 1996

[51] Int. Cl.[6] ..... F41A 21/00

[52] U.S. Cl. ..... 42/1.14; 89/5; 89/31

[58] Field of Search ..... 42/1.14; 89/1.809, 89/1.81, 31, 5

[56] References Cited

U.S. PATENT DOCUMENTS

| | | | |
|---|---|---|---|
| 367,153 | 7/1887 | Marsh | 89/5 |
| 1,186,023 | 6/1916 | Moore | 89/31 |
| 3,300,888 | 1/1967 | Belcher et al. | 42/1.14 |
| 3,453,763 | 7/1969 | Barr et al. | 42/59 |
| 3,494,060 | 2/1970 | Hendricks | 42/65 |
| 5,542,333 | 8/1996 | Hagelberg et al. | 89/1.81 |

*Primary Examiner*—Michael J. Carone
*Assistant Examiner*—Christopher K. Montgomery
*Attorney, Agent, or Firm*—Michael J. McGowan; James M. Kasischke; Prithvi C. Lall

[57] ABSTRACT

A sealing apparatus which may be mounted on multi or single barreled guns is disclosed to provide a watertight seal on an underwater gun. The sealing apparatus comprises a sealing plate connected to a gun barrel and a muzzle seal which fit on the muzzle of the gun barrel and frictionally engages the sealing plate. The sealing plate includes a firing aperture which aligns with the gun barrel when the gun is fired.

13 Claims, 2 Drawing Sheets

SEALING APPARATUS FOR EXCLUSION OF WATER FROM UNDERWATER GUN BARRELS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The present invention relates to a sealing apparatus for keeping water out of an underwater gun barrel both before, during and after the first shot and between shots in a series. More particularly, the invention relates to a novel sealing means for creating and maintaining a watertight seal on the muzzle of a gun barrel.

(2) Description of the Prior Art

Little work has been done on apparatus for keeping water out of a gun barrel because until recently it has not been practical to shoot bullets underwater. Newly proven, supercavitation drag reduction techniques now allow bullets to be fired underwater at high enough speeds to cause damage. Accordingly, there is a need for a simple and effective means for sealing underwater gun barrels to preclude the entry of water.

Excluding water from a gun barrel is important to underwater gun operation. If water is allowed to enter the gun barrel before or after firing the gun, the gun will not operate effectively.

The prior art includes various devices relating to underwater guns such as disclosed in U.S. Pat. Nos. 44,631; 367,153; 1,270,988; 3,300,888; 3,616,561; 3,323,457; 3,729,853; and 4,821,441. For example, U.S. Pat. No. 44,631 discloses a submarine shot conductor having an India-rubber valve mounted on the open end of the shot barrel. Similarly, U.S. Pat. No. 1,270,988 discloses an underwater gun whereby the gun muzzle is sealed by a pivotally mounted cap portion. U.S. Pat. No. 367,153 discloses a submarine gun and port whereby the port which receives the gun barrel is exposed by means of a sliding gate. Multishot guns for underwater use are disclosed in U.S. Pat. Nos. 4,821,441; 3,729,853; and 3,616,561. These prior art devices do not provide adequate sealing of the gun barrel to preclude the entry of water and/or are overly complex and not practical underwater guns.

Other devices are known in the art to render firearms waterproof as disclosed in U.S. Pat. Nos. 3,677,132; 4,742,775; 4,848,209; and 5,105,571. For example, U.S. Pat. No. 3,677,132 illustrates a muzzle attachment for the barrel of a firearm. The muzzle attachment includes a sealing device which prevents the escape of expanding gases after a bullet has been fired.

Similarly, U.S. Pat. No. 5,105,571 also relates to a method and apparatus for preventing moisture from entering a firearm. In this patent, lightweight plastic covers are disclosed for sealing the openings in a firearm.

U.S. Pat. No. 4,848,209 discloses a sealing apparatus for an underwater device including a barrel holder, a barrel for guiding a fastener intended to be driven by the gases of a propulsive charge and a percussion system for setting of the charge. The barrel of the device is closed by a closure device made by a material which may be perforated by the projectile disposed inside the tubular element or gun barrel.

U.S. Pat. No. 4,742,775 illustrates still another approach for sealing an end of an underwater device. In this patent, a sealing compound is used to prevent water from penetrating the casing.

Thus, the prior art does not disclose or suggest a device which can be easily mounted onto a conventional multi or single barreled gun which will render the gun barrel watertight and permit the gun to be fired without damaging the watertight seal.

SUMMARY OF THE INVENTION

Accordingly, it is a primary object of the invention to provide an effective sealing means to keep water out of an underwater gun barrel.

It is a further primary object of the invention to provide an effective sealing means to keep water out of an underwater gun barrel so that a bullet or other projectile is enveloped in gas until it leaves the gun barrel.

These objects are accomplished with the present invention by providing a muzzle sealing means which engages the gun muzzle and which frictionally engages a sealing plate means. The sealing plate has one or more firing apertures through which a bullet or other projectile can be fired when aligned with the gun muzzle.

The sealing plate keeps water from entering the gun barrel except when the apertures are aligned with the gun barrel. Discharge of the firing gun barrel is timed so that the bullet or other projectile and combustion gases keep the water from entering the firing aperture during the barrel-aperture alignment period. This keeps water out of the gun barrel and thereby reduces the amount of energy needed to eject a bullet or other projectile, and increases the muzzle velocity of the bullet.

The novel sealing means of the invention is applicable to single and multibarreled guns. The sealing means includes a muzzle seal means which engages a gun muzzle of the gun barrel. The muzzle seal means comprises tubular face seal means for engaging the gun muzzle, a shaft seal means for sealing the face seal and a spring means for providing down-load pressure. The muzzle seal means frictionally engages a sealing plate means attached to the gun. The sealing plate means includes one or more firing apertures for alignment with the gun muzzle for firing the gun barrel. The sealing plate or the gun muzzle rotates to align the gun muzzle and firing aperture of the sealing plate for firing the gun.

BRIEF DESCRIPTION OF THE DRAWING

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENT

Figure 1:
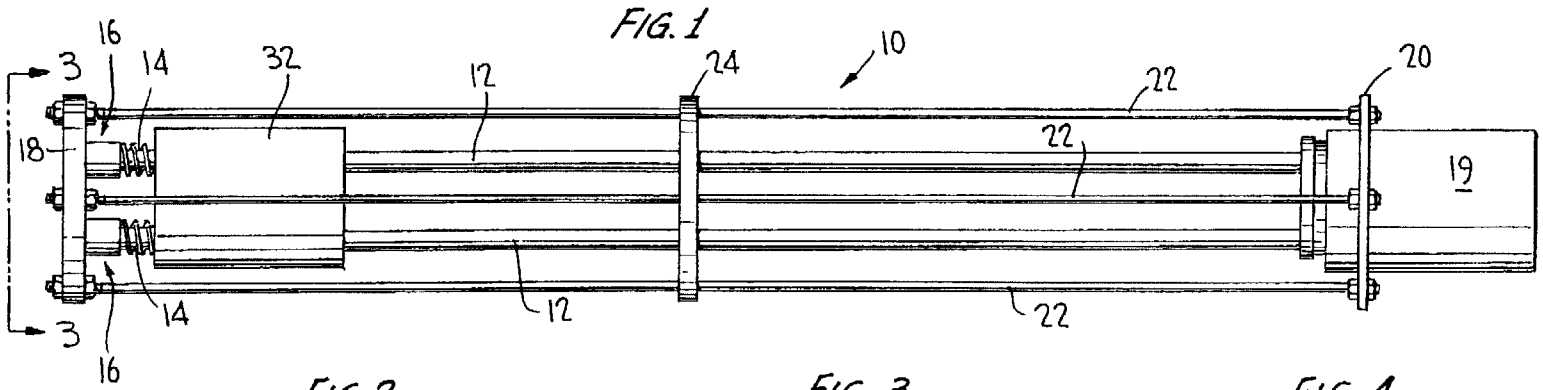
FIG. 1 is a side view of a Gatling gun using the sealing means of the invention.

A first preferred embodiment of the sealing apparatus of the invention is illustrated on a multi-barreled gun such as a four barreled Gatling gun generally designated as 10 in FIG. 1. Generally, Gatling gun 10 has multiple gun barrels 12. As shown in FIG. 1, gun 10 has four barrels 12. Each barrel 12 has a gun barrel muzzle 14 and muzzle seal 16. A sealing plate 18 is connected to a gun housing 19 by bracket means 20 and supporting rods 22. A support ring 24 is utilized for further support along barrels 12.

Figure 2:
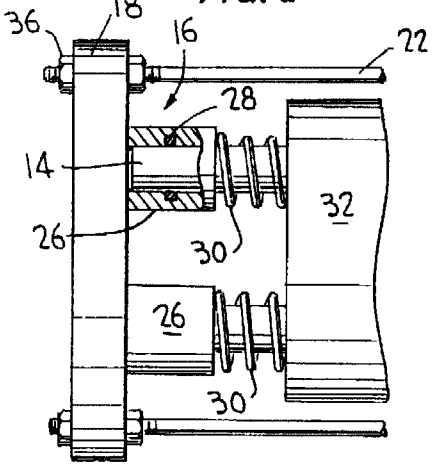
FIG. 2 is an enlarged and partial sectional view of the muzzle seal means of FIG. 1 showing the details of the muzzle seal on the gun muzzle.

As seen in FIG. 2, muzzle seal 16 fits over and engages the gun barrel muzzle 14. Muzzle seal 16 comprises a tubular face seal 26, a shaft seal 28, and a spring means 30. The face seal 16 is made of any seawater resistant material such as carbon, ceramic or other like material. Besides being seawater resistant, the material must resist the high temperature of the combustion gases upon firing of the gun 10. Face seal 26 is slidably mounted. Shaft seal 28 is fitted in a groove in the interior of the face seal 16 and preferably includes an 0-ring. The shaft seal 28 provides a watertight seal between the face seal 26 and the gun muzzle 14.

Spring means 30 engages a stop means 32 and provides frictional down-load pressure on the face seal 26 against sealing plate 18. This pressure ensures a watertight seal between muzzle seal 16 and sealing plate 18.

Figure 4:
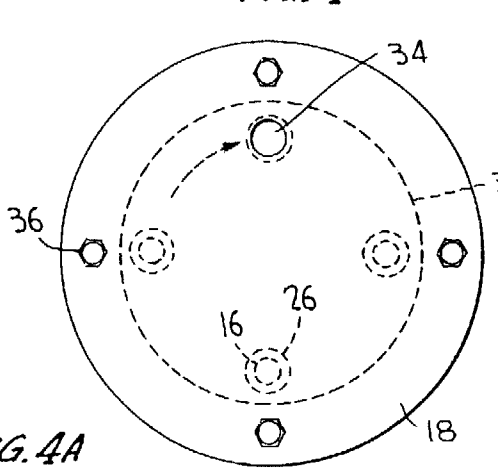
FIG. 4 is a front view of FIG. 1 showing the firing aperture of the sealing plate and the gun muzzles in firing position.
Figure 3:
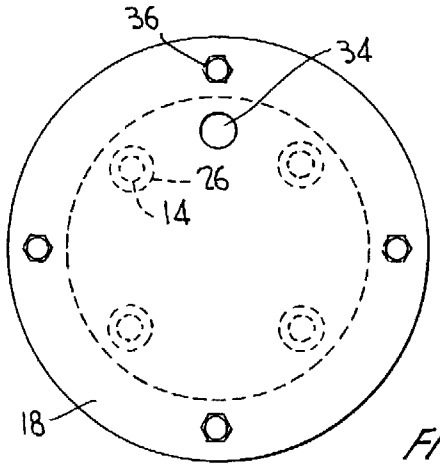
FIG. 3 is a front view of FIG. 1 showing the firing aperture of the sealing plate and the gun muzzles in non-firing position.

Sealing plate 18, as best shown in FIGS. 3 and 4, includes a firing aperture 34. The sealing plate is attached to the gun 10 by means of threaded support rods 22 which are held in place by nut means 36 or any other suitable fastening means.

FIG. 3 illustrates the sealing plate 18 in non-firing position with the gun muzzles 14 with face seals 26 (shown in phantom lines). None of the gun muzzles 14 are in alignment with firing aperture 34.

FIG. 4 illustrates the sealing plate 18 in firing position wherein a gun muzzle 14 is in alignment with firing aperture 34. As apparent, the face seal 26 of muzzle seal 16 has a larger diameter than the firing aperture 34.

Figure 4A:
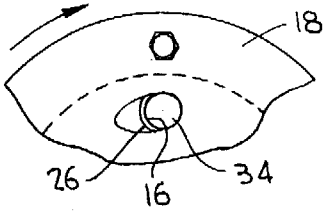
FIG. 4A is an alternative embodiment of the firing aperture of the sealing plate of FIG. 1.

In operation, one muzzle seal 16 is mounted on each gun muzzle 14 and frictionally engages sealing plate 18. The gun barrels 12 rotate half a position and firing begins. The gun barrels 12 rotate one full position between shots. When firing is completed, the gun barrels 12 rotate a half of position to seal the face seal 26 of muzzle seal 16 against the sealing plate 18. The discharge of each gun barrel 12 is timed so that the projectile and combustion gases keep the water from entering firing aperture 34. As seen in FIG. 4A, firing aperture 34 can be oblate to allow combustion gases to escape after the barrel 12 has begun moving the next firing position.

Figure 5:
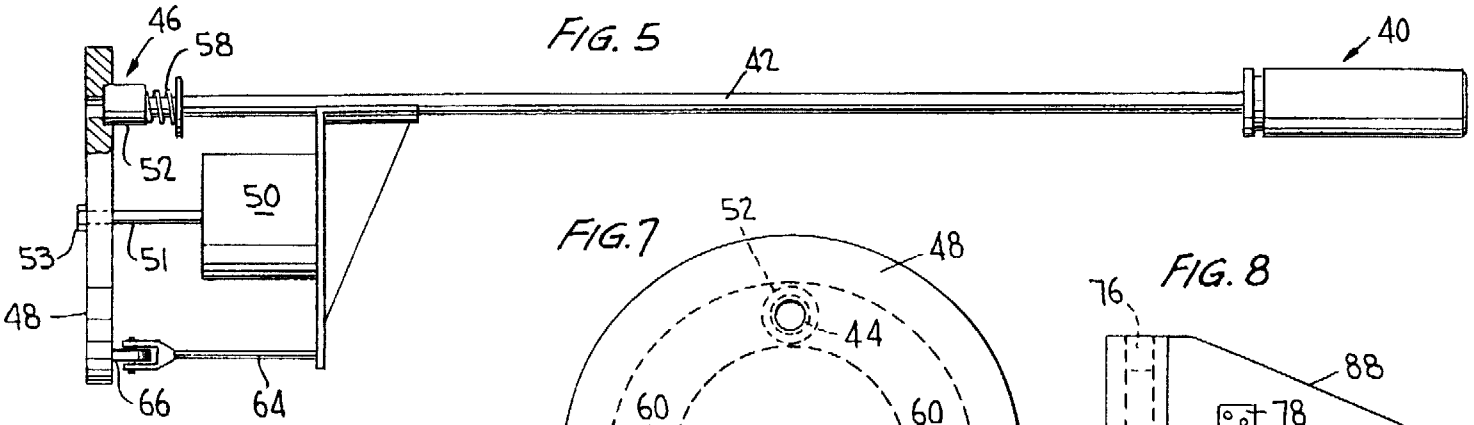
FIG. 5 is a side view of a single barrel gun using the sealing means of the invention.
Figure 7:
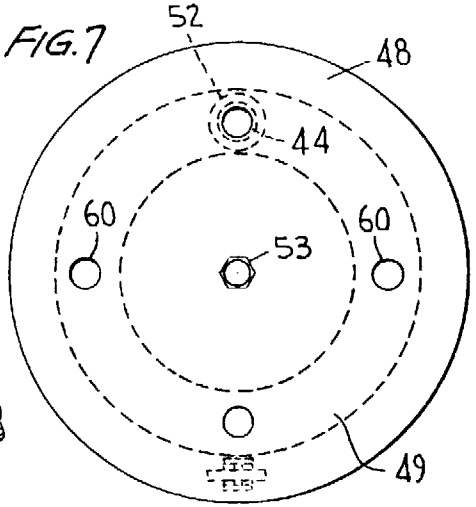
FIG. 7 is a front view of FIG. 5 which shows the sealing plate with multiple firing apertures and in firing position.
Figure 6:
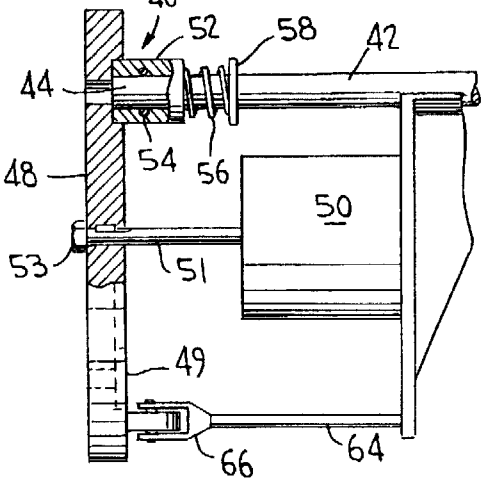
FIG. 6 is an enlarged partial sectional view of FIG. 5 showing the muzzle seal, sealing plate and actuating means for rotating the sealing plate.

FIGS. 5 through 7 illustrate a single barrel gun 40 having a gun barrel 42, a muzzle 44, a muzzle seal 46, a sealing plate 48 and a waterproof actuating means 50 which rotates sealing plate 48. The sealing plate 48 is fastened to actuating means 50 by a shaft and fastener assembly 51 and 53. Actuating means 50 can be joined to gun barrel 42.

FIG. 6 illustrates in greater detail the sealing apparatus of the invention on the gun muzzle 44. The muzzle seal 46 is constructed and arranged as described above for the Gatling gun. Muzzle seal 46 includes a tubular face seal 52, a shaft seal 54, and a spring means 56. Spring means 56 engages stop means 58 and provides for frictional engagement of face seal 52 with sealing plate 48. Sealing plate 48 can be provided with a groove 49 to accommodate face seal 52 thereby enhancing sealing. As shown, a support arm 64 is provided with a support wheel 66 to maintain sealing plate 48 against face seal 52.

As seen in FIG. 7, sealing plate 48 includes multiple firing apertures 60. Sealing plate 48 is rotated by actuating means 50. Actuating means 50 can be any shaft 51 rotating means. It is envisioned that actuating means be driven by the same mechanism used to feed the bullets. As an alternative, actuating means 50 can be a stepper motor capable of accurately aligning aperture 60 with muzzle 44. As shown in FIG. 7, the sealing plate 48 is rotated to align the firing apertures 60 with the gun muzzle 44. Firing of the single barrel gun 40 is similar to that described for the Gatling gun of FIG. 1 except that sealing plate 48 is rotated by the actuating means 50.

As seen above for the Gatling gun, the face seal 52 is of a larger diameter than the firing aperture 60 to provide for an effective watertight seal.

Figure 8:
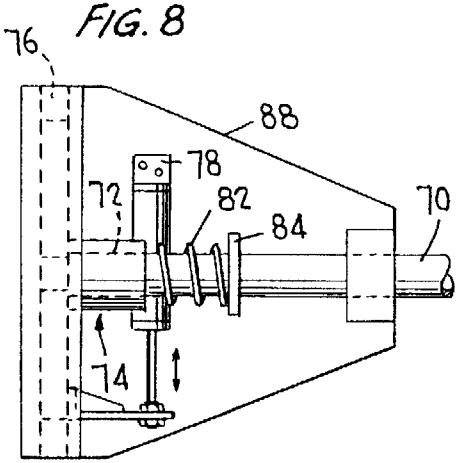
FIG. 8 is an enlarged plan side view of another single barrel gun in which a sealing plate is slidably mounted with a single firing aperture in relation to the gun muzzle.
Figure 9:
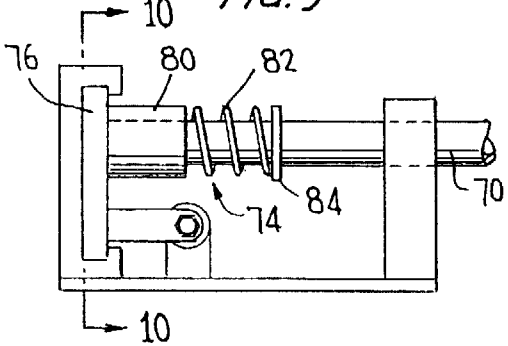
FIG. 9 is an enlarged side view of the sealing means of FIG. 8.
Figure 10:
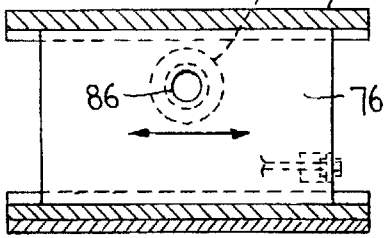
FIG. 10 is a front view of FIG. 8 in firing position.

FIGS. 8 through 10 disclose another embodiment of the invention on a single barrel gun. The single barrel gun includes a gun barrel 70 with a gun muzzle 72. A muzzle seal 74, a sealing plate 76 and an actuating means 78 are provided in the embodiment of the invention. The muzzle seal 74 is the same as described above for the previous embodiments and includes a face seal 80, a shaft seal means (not shown) and a spring means 82. Face seal 80 is slidably disposed on muzzle 72. Spring means 82 engages stop means 84 and provides for frictional engagement of face seal 80 with sealing plate 76. Sealing plate 76 is attached to gun barrel 70 by a corrosion resistant bracket 88. In operation, actuating means 78 causes sealing plate 76 to slide to align a firing aperture 86 with gun muzzle 72. Actuating means 78 can be a solenoid or hydraulic actuator having the ability to precisely align aperture 86 with muzzle 72.

As seen for the above-description, the sealing apparatus of this invention provides a novel and simple means for providing a watertight seal for an underwater gun.

In light of the above, it is therefore understood that within the scope of the following claims, the invention may be practiced otherwise than as specifically described.

What is claimed is:

1. An underwater gun barrel seal for preventing fluid from entering a gun barrel comprising:

a muzzle seal means joined to a muzzle of said gun barrel, said muzzle seal means allowing discharge from said gun barrel;

a sealing plate joined in a movable relation to said barrel and having at least one firing aperture therein, said sealing plate having at least two positions in relationship to said gun barrel, a first position wherein communication through said gun barrel muzzle is prevented by said sealing plate and a second position wherein communication through said gun barrel muzzle is allowed through said firing aperture, said muzzle seal means being positioned against said sealing plate; and an actuating means joined between said sealing plate and said gun barrel for moving said sealing plate between said first position and said second position.

2. The invention of claim 1 wherein said firing aperture is oblong.

3. The invention of claim 1 wherein said muzzle seal means has a muzzle seal aperture therein that has a diameter greater than the diameter of said firing aperture.

4. The invention of claim 1 wherein said muzzle seal comprises:

a face seal means which fits over the muzzle of said gun barrel;

a shaft seal means constructed and arranged on the inside of said face seal means and engaging said muzzle; and a spring means engaging said face seal means.

5. The invention of claim 1 wherein said gun is a single barrel gun.

6. The invention of claim 5 wherein said actuating means rotates said sealing plate for positioning said firing aperture with the muzzle.

7. The invention of claim 6 wherein said actuating means slidably moves said sealing plate to align said firing aperture with said gun barrel.

8. The invention of claim 5 wherein said firing aperture is oblong.

9. The invention of claim 6 wherein said firing aperture is oblong.

10. An underwater gun barrel seal for preventing fluid from entering a multi-barrel gun comprising:

a muzzle seal means mounted on said multi-barrel gun having a face seal means which fits over the muzzle of each said gun barrel, a shaft seal means constructed and arranged on the inside of said face seal means and engaging said muzzle, and a spring means engaging said face seal means, said muzzle seal means allowing discharge from at least one said gun barrel;

a sealing plate joined to said multi-barrel gun barrels to allow relative movement between said sealing plate and said multi-barrel gun barrels, said sealing plate having at least two positions in relationship to said gun barrels, a first position wherein communication through said gun barrel muzzles is prevented by said sealing plate and a second position wherein communication through at least one said gun barrel muzzle is allowed, said muzzle seal means being positioned against said sealing plate; and an actuating means joined between said sealing plate and said multi-barrel gun barrels and providing relative motion between said sealing plate and said gun barrels from said first position to said second position.

11. The invention of claim 10 wherein said sealing plate means includes a firing aperture constructed and arrange to align with a muzzle of said multi-barrel gun.

12. The invention of claim 11 wherein said firing aperture is oblong.

13. The invention of claim 10 wherein said sealing plate includes multiple firing apertures arranged to align with the currently firing muzzle of said multi-barrel gun.

* * * * *